United States Patent [19]

Culver

[11] Patent Number: 4,919,325

[45] Date of Patent: Apr. 24, 1990

[54] COMBINATION WINDOW ENVELOPE AND INSERT AND METHOD OF USING SAME

[76] Inventor: William P. Culver, P.O. Box 2236, Rancho Sante Fe, Calif. 92067

[21] Appl. No.: 244,816

[22] Filed: Sep. 14, 1988

[51] Int. Cl.[5] ..... B65D 27/04

[52] U.S. Cl. ..... 229/71

[58] Field of Search ..... 229/71, 73

[56] References Cited

U.S. PATENT DOCUMENTS

| | | | |
|---|---|---|---|
| 1,601,318 | 6/1931 | Overly | 229/71 |
| 1,741,059 | 12/1929 | Jones | 229/71 |
| 1,858,277 | 5/1932 | Overly | 229/71 |
| 1,964,595 | 6/1934 | Overly | 229/71 |
| 1,977,042 | 10/1934 | Cather | 229/71 |
| 1,979,917 | 11/1934 | Vaughn | 229/71 |
| 1,984,901 | 12/1934 | Swift | 229/71 |
| 2,209,601 | 7/1940 | Heywood | 229/71 |
| 2,317,497 | 4/1943 | Thompson | 229/72 |
| 2,997,225 | 8/1961 | Whitman | 229/71 |
| 3,013,713 | 12/1961 | Whitman | 229/71 |
| 3,062,431 | 11/1962 | Rabenold | 229/73 |
| 3,195,802 | 7/1965 | Jacobs | 229/71 |
| 3,321,127 | 5/1967 | Miller | 229/71 |
| 3,391,854 | 7/1968 | Lohausen | 229/71 |
| 3,420,432 | 1/1969 | Cooper | 229/71 |
| 3,512,702 | 5/1970 | Pritchard, Jr. | 229/73 |
| 3,777,971 | 12/1973 | Steidinger | 229/69 |
| 3,982,689 | 9/1976 | Retrum | 229/73 |
| 4,444,356 | 4/1984 | Hays | 229/72 |
| 4,778,101 | 10/1988 | Paquin | 229/73 |
| 4,799,618 | 1/1989 | Jenkins | 229/71 |

*Primary Examiner*—Stephen P. Garbe

*Attorney, Agent, or Firm*—Bernard L. Kleinke; Jerry R. Potts; William Patrick Waters

[57] ABSTRACT

A new and improved window envelope and insert combination for enabling a pre-printed insert, with window information thereon, to be properly positioned within the envelope relative to the envelope window so that the pre-printed information is exposed through the window. In order to insure that the insert will be properly positioned within the envelope relative to the window, the envelope has one corner thereof sealed together, and the insert forming a portion of the document has one corner thereof truncated after separation from the remaining portions of the document. The method of using the window envelope with the perforated insert includes placing a finger of the user on the receipt portion of the document near the perforated angular corner of the insert portion of the document and then tearing the receipt portion of the document from the insert portion of the insert along the perforation line. When the insert portion is then separated from the receipt portion, the separated insert portion becomes the envelope insert for fitting into the invention envelope having a complementary shaped inner pocket.

21 Claims, 1 Drawing Sheet

COMBINATION WINDOW ENVELOPE AND INSERT AND METHOD OF USING SAME

TECHNICAL FIELD

The present invention relates in general to combination window envelopes and inserts therefor, and more particularly relates to a new and improved combination window envelope and insert having a special control features to enable the pre-printed insert having window information to be positioned properly within its envelope window.

BACKGROUND ART

A conventional window envelope insert generally includes instruction indicia to instruct a user to align the pre-printed insert having window information thereon within the window of the envelope. However, on many occasions, the user fails to read the instructions and inadvertently places the insert in the envelope backwardly, or in an upside-down manner, or in an upside-down and backward manner, so that the window information disposed on the insert is not aligned in the envelope window. Thus, the window information or address is not exposed to view.

When the address on the insert is not properly exposed to view, unwanted post office delays can occur. Also, in the case of invoices, undesirable delays in payment thereof can result. Additionally, money or other forms of payment may well be lost.

Thus, there have been a number of attempts to overcome the problems of positioning properly a document insert within a window envelope. For example, reference may be made to the following U.S. Pat. Nos. 1,601,318; 2,317,497; 3,391,854; and 4,334,618.

Thus, several attempts have been made to overcome the positioning problem. For example, as shown in U.S. Pat. No. 3,391,854, conventional window envelopes have been designed with a mutilated corner to receive a computer punched card having a truncated or missing corner, so as to cause the shape of the interior of the envelope to conform to the shape of the card. In this manner, the card can only be inserted fully into the envelope in the desired manner Otherwise, the card can not be fully inserted, and thus the user is immediately alerted to the improper positioning.

However, although mutilating the envelope reduces the possibility of inserting a pre-addressed card into an envelope upside downwardly or backwardly, it requires that the envelope and the card both be mutilated. Thus, they do not present an aesthetically pleasing appearance. As a result, such a technique would not be satisfactory for use in business correspondence, such as where the envelope and insert combination is sent to a customer or client as an invoice. In other words, mutilated invoices and inserts are too undignified for such use.

Therefore, it would be highly desirable to have a window envelope and insert combination, which eliminate the mutilation problem entirely. Such a new envelope and window combination should enable the pre-addressed envelope insert to be positionable within the envelope properly, and yet alert the user immediately to an improper insertion.

In U.S. Pat. No. 2,317,497 another attempted solution to the positioning problem, without resorting to the highly objectable mutilation technique, is shown. This solution employs the utilization of a window envelope with the window disposed nearer to one of the envelope corners than to any of the other corners and is in proximity to one end of the envelope so that a small insert card can be inserted into a large envelope and be retained in place within the window portion of the envelope by a stop formed by a strip of gum. This attempt has also proven to be less than completely satisfactory, in that the insert could still be improperly inserted, upside down or backward, and was limited to a generally small size.

Another attempt to solve the positioning problem, was to use strips of adhesive material positioned at substantially right angles to each other on the inside of the envelope so that the bottom and side flaps of the envelope would adhere to the strips and form a small pocket for receiving and retaining a small card or insert in the desired position relative to the window. While this attempted solution did not require the mutilation of the envelope and of the insert, it also has proven to be less than satisfactory, in that it can only accommodate small inserts and still did not solve the problem of the insert being positioned improperly within the envelope. In this regard, the small card can be inserted inadvertently in an upside down, or backward manner relative to the envelope window.

Therefore, it would be highly desirable to have a new and improved combination envelope and insert, as well as a method of using to reduce greatly, if not eliminate totally, the problem of a pre-printed insert being improperly inserted in the envelope. Such a combination should not require mutilation, nor the use of an insert which is smaller in size as compared to its envelope. Such a combination should permit utilization of an insert having dimensions that approximate the size of the envelope, with little modification of the envelope or of the insert.

DISCLOSURE OF THE INVENTION

Therefore, the principal object of the present invention is to provide a new and improved window envelope and envelope insert combination and method of using the same, for permitting the window information on the insert to be aligned properly with the envelope window, and to alert the user to an improper or undesired insertion.

Another object of the present invention is to provide such a new and improved window envelope and envelope insert combination, and method of using the same, to prevent improper insertion of the insert into the envelope, without the need for mutilating either the envelope or the insert, and without the need for a smaller size insert relative to the size of its envelope.

Briefly, the above and further objects and features of the present invention are realized by providing a new and improved window envelope and insert combination for enabling a pre-printed insert, such as an invoice or other business document, to be positioned properly within the envelope relative to the envelope window so that the pre-printed information is exposed through the window. In order to insure that the insert will be properly positioned within the envelope relative to the window, the envelope has one corner thereof sealed together, and the insert forming a portion of the document has one corner thereof truncated after separation from the remaining portion of the document. In this manner, the insert can only be positioned with the truncated corner of the insert mating with the sealed corner portion of the envelope.

The insert member is constructed with a transverse tear line perforation, which includes an angular portion, so that when the insert portion of the document is separated from the remaining or receipt portion along the perforation, the insert portion thereof forms the envelope insert having a truncated corner. Thus, the business document, such as an invoice of the present invention, is not mutilated in any manner, and the envelope insert formed therefrom has a truncated corner formed by the convenient method of separating the envelope insert portion from the remaining portion of the document.

The method of using the window envelope with the perforated insert includes placing a finger of the user on the receipt portion of the document near the perforated angular corner of the insert portion of the document, and then tearing the receipt portion of the document from the insert portion along the perforation line. When the insert portion is thus separated from the receipt portion, the separated insert portion becomes the envelope insert for fitting into the inventive envelope having a complementary shaped inner pocket. The outer surface and shape of the inventive envelope is virtually indistinguishable from a conventional window envelope.

In the preferred form of the invention, the insert with the missing corner is placed in the window envelope so that the truncated corner portion of the insert matingly engages the sealed off corner portion of the inner pocket of the envelope. The mating engagement of the insert with the sealed portion of the envelope eliminates entirely the problem of improper insertion of the insert into the envelope, and insures the pre-printed window information on the insert will be properly aligned within the window. In this regard, should the inventive insert be inserted improperly, such as up-side-downwardly, the truncated corner of the insert does not mate with the sealed off corner portion of the envelope pocket. Instead, another corner of the insert engages the sealed off envelope corner to prevent any further insertion of the insert into the envelope. Thus, the user is immediately alerted to the improper insertion.

Furthermore, due to the utilization of a window envelope with a sealed inner corner, the envelope is relatively inexpensive to manufacture, and its manufacture may be readily incorporated into existing envelope manufacturing systems. Also, as the utilization of perforated documents is currently conventional in the industry, the inventive document construction is also relatively inexpensive to manufacture and may be easily manufactured by modifying document manufacturing systems.

BRIEF DESCRIPTION OF DRAWINGS

The above mentioned and other objects and features of this invention and the manner of attaining them will become apparent, and the invention itself will be best understood by reference to the following description of the embodiments of the invention in conjunction with the accompanying drawings, wherein.

BEST MODE FOR CARRYING OUT THE INVENTION

Figure 1:
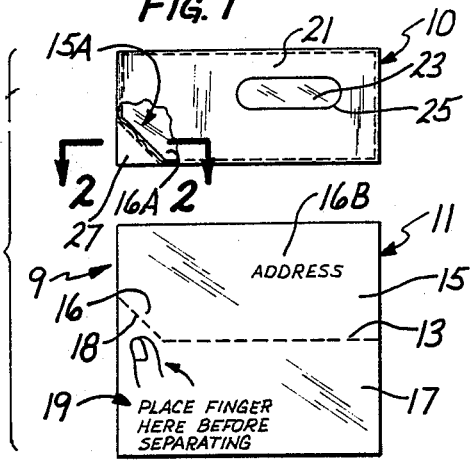
FIG. 1 is an elevational view, of a combination window envelope and a pre-printed perforated invoice, which is constructed in accordance with the present invention.

Referring now to the drawings, and more particularly to FIG. 1 thereof, there is shown a new and improved combination 9 of a window envelope 10 and pre-printed perforated document or invoice 11, which is constructed in accordance with the present invention.

As best seen in FIG. 1 the pre-printed invoice 11 is generally rectangular in shape having a perforation line 13 dividing the invoice 11 into a top insert portion 15 and a bottom receipt portion 17. When the invoice 11 is separated along the line 13, the top portion 15 may then be utilized in the envelope 10 as the inventive insert, such as the insert 15A shown disposed inside the envelope 10, as will be described hereinafter in greater detail.

When the top portion 15 has been separated from the invoice 11, there is formed a truncated corner at 16, such as the truncated corner 16A of the insert 15A. The resulting insert, such as the insert 15A, is shaped to conform to the interior pocket of the window envelope 10, as will be described hereinafter in greater detail. The top portion 15 includes a pre-printed address indicia 16B where the pre-printed address indicia 16B illustrated on the drawing, is a mailing address. It should be understood that other indicia intended to be viewed within the window of the window envelope 10, may be pre-printed on the top portion 15 of the invoice 11.

The bottom receipt portion 17 of the invoice 11 is also generally rectangular in shape except for its upper left corner which terminates in a chamfered edge 18. The bottom receipt portion 17 of the invoice 11 further includes instruction indicia 19 disposed adjacent the chamfered edge 18. The instruction indicia 19 is provided to help direct a user in the method of separating the top portion 15 from the bottom portion 17 along the perforation line 13.

Figure 2:
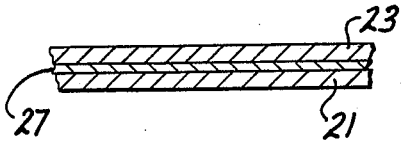
FIG. 2 is an enlarged fragmentary sectional view of the window envelope of FIG. 1 taken substantially on line 2-2 of FIG. 1.

Considering now the window envelope 10 in greater detail with reference to FIGS. 1 and 2, the envelope 10 is generally rectangular in shape in accordance with conventional envelope shapes and includes a front 21 and back 23. A portion of the envelope 10 has been removed or cut from the front 21 to form a window 25, so that pre-printed indicia on an insert, such as indicia 16A on insert 15, may be viewed in the window 25 of the envelope 10. It should be understood that the window portion 25 may be covered by a sheet of transparent material applied to the inner surface of the front 21 of the envelope in a conventional manner.

The back 23 or the envelope 10 includes a standard top flap portion (not shown) which is gummed in the conventional manner so that the envelope 10 may be sealed after the insertion of an insert, such as insert 15.

In order to adapt the envelope 10 to receive the insert or upper portion 15 of the invoice 11, in one orientation only, a quantity or layer of adhesive material 27, is positioned at the lower left corner of the envelope 10 between the inner surfaces of the front 21 and back 23 of the envelope 10. In this manner, the inner surfaces of front and back 21 and 23 of the envelope 10 are sealed together so that the insert 15 may be received into interior pocket of the envelope 10 in one orientation only, e.g. with the truncated corner 16 positioned in the bottom left corner of the envelope and with the address indicia 16A in the window 25. While the layered adhesive 27 is illustrated in the drawing as being located substantially in the lower left corner of the envelope, it should be understood that it may be located at other positions between the inner surfaces of the front and back 21 and 23 of the envelope 10 depending on the configuration of the upper portion 15 of the invoice 11.

Figure 3:
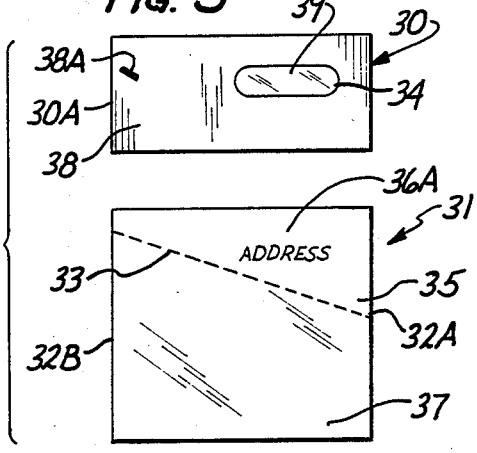
FIG. 3 is an elevational view of another combination window envelope and pre-printed perforated invoice, which is also constructed in accordance with the present invention.

FIG. 3 shows another window envelope 30, and insert or invoice 31 which is constructed in accordance with the present invention.

As best seen in FIG. 3 the pre-printed invoice 31 is generally rectangular in shape having a perforation line 33 extending from the right edge 32A angularly upwardly toward the left edge 32B. The perforation line 33 divides the invoice 31 into a top insert portion 35 and a bottom receipt portion 37. When the invoice 31 is separated along the line 33, the top portion 35 may then be utilized in the envelope 30 as the inventive insert as will be described hereinafter in greater detail.

When the top insert portion 35 has been separated from the invoice 31, there is formed an insert that is shaped to conform to the interior of window envelope 30 as will be described hereinafter in greater detail. The insert 35 generally includes a lower angular edge that extends from its lower right corner to its lower left corner. The insert portion 35 also includes a pre-printed address indicia 36A which may be viewed within a window 34 of the window envelope 30.

The bottom receipt portion 37 of the invoice 31 includes a top angular edge that is complementary to the lower angular edge of the top portion 35 extending downwardly from its upper left corner to its upper right corner.

Considering now the window envelope 30 in greater detail with reference to FIG. 3, the envelope 30 is generally rectangular in shape in accordance with conventional envelope shapes and includes a front 38 and a back 39. The window portion 34 of the envelope 30 has been removed or cut from the front 38 so that pre-printed indicia on an insert, such as indicia 36A on insert 35, may be viewed in the window portion 34 of the envelope 30. The back 32 of the envelope 30 includes a standard top flap (not shown) which is gummed in the conventional manner so that the envelope 30 may be sealed after the insertion of an insert, such as insert 35.

In order to adapt the envelope 30 to receive the top insert portion 35 of the invoice 31, in one orientation only, any convention securing means, such as staple 38A, is provided adjacent the left edge 30A of the envelope 30. The staple 38A is angularly oriented so that its angle of orientation corresponds to the angular orientation of the lower edge of the insert 35. In this manner, the staple 38A seals the front and back 38 and 39 of the envelope 30 together so that insert 35 may be received into the envelope 30 in one orientation only with the address indicia 36A in the window 34. While the securing means 38A is illustrated in the drawing as being angled to correspond to the angular slope of the insert 35, it should be understood that it may be located in other positions to secure together the inner surfaces of the front and back 38 and 39 of the envelope 30 depending on the configuration of the insert portion 35 of the invoice 31.

Figure 4:
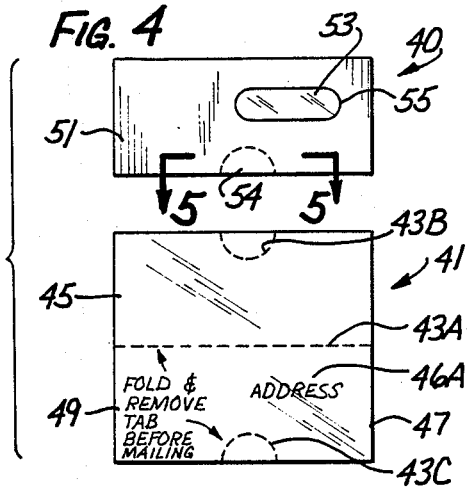
FIG. 4 is an elevational view of yet another combination window envelope and pre-printed perforated invoice, which is also constructed in accordance with the present invention.

FIG. 4 shows yet another window envelope 40 and invoice 41 which is also constructed in accordance with the present invention.

As best seen in FIG. 4, the pre-printed invoice 41 is generally rectangular in shape having a perforation line 43A. The perforation line 43A divides the invoice 41 20 into a bottom insert portion 47 and a top receipt portion 45. The invoice 41 also includes a pair of semi-circle perforation lines 43B and 43C that are disposed at the opposite ends of the invoice 41 along the center longitudinal axis of the invoice 41.

The top receipt portion 45 of invoice 41 includes the perforation line 43B, while the bottom insert portion 47 includes the perforation line 43C. Perforation lines 43B and 43C align when invoice 41 is folded horizontally along the perforation line 43A. Thus, when the invoice 41 has been folded along line 43A, it may be grasped at the perforation semi circle areas formed by lines 43B and 43C and at the opposite folded edge of the invoice 41, and snapped. In this manner, the semi circle areas of the invoice 41 may be snapped out and removed from invoice 41. Accordingly, when the semi circle area has been removed from the bottom insert portion 47, there is formed a truncated bottom edge. The resulting insert portion 47 is shaped to conform to the interior pocket of the window envelope 40, as will be described hereinafter in greater detail. The bottom invoice portion 47 includes a pre-printed address indicia 46A intended to be viewed within a window 55 of the window envelope 40.

The bottom invoice portion 47 of the invoice 41 further includes instruction indicia 49 disposed between the perforated lines 43A and 43C. The instruction indicia 49 is provided to help direct a user in the method of removing the perforated semi circle area along the lines 43B and 43C.

Figure 5:
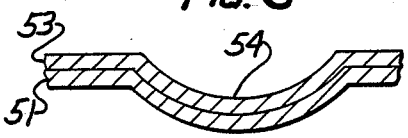
FIG. 5 is an enlarged fragmentary sectional view of the window envelope of FIG. 4 taken substantially on line 5—5 of FIG. 4.

Considering now the window envelope 40 in greater detail with reference to FIGS. 4 and 5, envelope 40 is generally rectangular in shape in accordance with conventional envelope shapes and includes a front 51 and back 53. The window portion 55 of the envelope 40, has been removed or cut from the front 51 so that pre-printed indicia on an insert, such as indicia 46A on insert 47, may be viewed in the window portion 55 of the envelope 40. The back 53 of envelope 40 includes a standard top flap portion (not shown) which is gummed in the conventional manner so that envelope 40 may be sealed after the insertion of an insert, such as insert 47.

In order to adapt the envelope 40 to receive the insert portion 47 of the invoice 41, in one orientation only, the lower central portion of envelope 40 is crimped so that the inner surfaces of the front and back 41 and 43 are meshed together to form a solid semi circular seal 54 between the respective surfaces. In this manner, the insert 47 must be received into the interior pocket of the envelope 40 in one orientation only, with its truncated edge positioned in alignment with the crimped semi circular area 54 and the address indicia 46A in the window 55.

Figure 6:
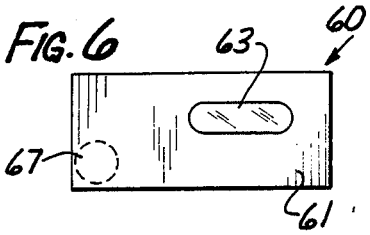
FIG. 6 is an elevational view of yet another combination window envelope and invoice, which is also constructed in accordance with the present invention, the invoice not being illustrated.

Another form of a window envelope 60 is shown in FIG. 6 that is constructed in accordance with the present invention. The construction shown in similar to that of FIG. 1 except the front and back surfaces 61 and 63 are perforated together in a general area, such as area 67, by an embossing seal device (not shown) so that an insert, such as insert 15, may be received in one orientation only with the truncated corner positioned in the bottom left corner of the envelope 60.

Figure 7:
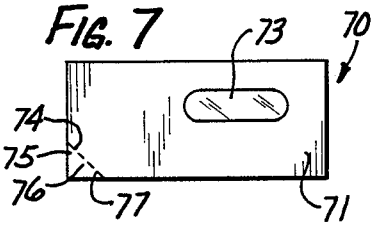
FIG. 7 is an elevational view of yet another combination window envelope and invoice, which is also constructed in accordance with the present invention, the invoice not being illustrated.

Another form of a window envelope 70 is shown in FIG. 7 that is constructed in accordance with the present invention. The construction shown is similar to that of FIG. 1 except the front and back surfaces 71 and 73 are stapled together by a row of staples 74, 75, 76 and 77 so that an insert, such as insert 15, may be received in one orientation only with the truncated corner positioned in the bottom left corner of the envelope 70.

Figure 8:
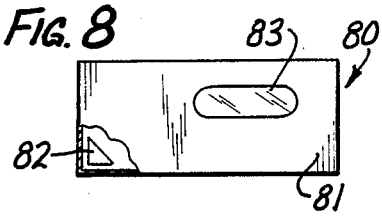
FIG. 8 is an elevational view of yet another combination window envelope and invoice, which is also constructed in accordance with the present invention, the invoice not being illustrated.

Another form of a window envelope 80 is shown in FIG. 8 that is constructed in accordance with the present invention. The construction shown in similar to that of FIG. 1 except a gummed insert 82 is positioned with the interior of the envelope at the bottom left corner to seal the inner surfaces of the front and back portions 81 and 83 of the envelope 80 together. In this manner, an insert, such as insert 15 may be received in one orientation only with the truncated corner positioned in the bottom left corner of the envelope 80.

Figure 9:
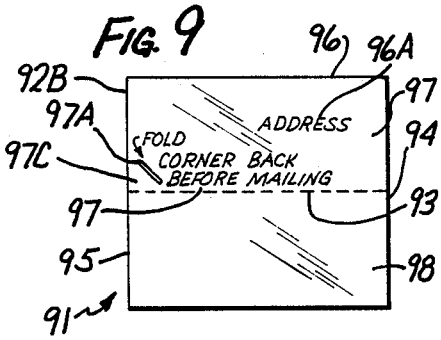
FIG. 9 is an elevational view of another combination envelope and pre-printed perforated invoice, which is also constructed in accordance with the present invention, the envelope not being illustrated.

FIG. 9 shows another invoice or document 91 which is constructed in accordance with the present invention.

As best seen in FIG. 9 the pre-printed invoice 91 is generally rectangular in shape having a perforation line 93 extending from the right terminate edge 94 toward the left terminal edge 95 parallel to the top edge 96 of the invoice 91. The perforation line 93 divides the invoice 91 into a top insert portion 97 and a bottom receipt portion 98. When the invoice 91 is separated along the line 93, the top portion 97 may be utilized in an envelope, such as envelope 40, 60, 70 or 80 as will be described hereinafter in greater detail.

The resulting insert, such as insert 97, is shaped to conform to the interior pocket of a window envelope, such as envelope 40, 60, 70 or 80 as will be described hereinafter in greater detail. The top portion 97 includes a pre-printed The top portion 97 also includes an instruction indicia 97 disposed adjacent the lower left corner of the top portion 97. The instruction indicia 97 generally comprises a single line 97A that extends from the left edge 92B angularly downwardly toward the bottom edge of the top portion 97 formed along line 93. In this manner, the bottom left corner 97C of the invoice 91 may be folded along the line 97A when a user reads and follows the pre-printed instruction indicia 97 on the invoice 91. When the corner of the top insert portion 97 has been folded, it may be inserted into the envelope, such as envelope 40.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. An envelope system comprising:

a document member having a document separation tear line of perforations extending from its right side edge to its left side edge, said tear line of perforations dividing said document member into a top and bottom portion, wherein at least one of said top and bottom portions is an envelope insert member;

a substantially rectangular envelope having a front and back panel connected in facing relation along their lower, left and right edges; said front and back panels forming a closable opening to the interior of said envelope;

said opening being closable by an integral flap extending from the top edge of the front panel, said flap having sealing means for securing said flap to the exterior surface of said back panel;

said front panel having an opening therein defining a window for permitting at least one surface of said insert member to be viewed when said insert member is disposed within the interior of said envelope;

securing means disposed within the interior of said envelope and extending diagonally between a side edge and the bottom edge thereof for binding together a portion of the interior of said front and back panels of said envelope;

said portion defining a stop within the interior of said envelope and defining an interior envelope insert member receiving space, said space being substantially the same size as said envelope insert member;

said document member having a manually removable portion, said removable portion being defined by a tear line of perforations intersecting at least one edge of said document for enabling a user to form a stop engageable portion of said envelope insert member, said stop engageable portion being complementary shaped relative to said removable portion; and said stop engageable portion being disposed on said envelope insert member in a similar orientation as the position of said stop member to permit said stop engageable portion to be positioned adjacent to said stop when said envelope insert member is disposed within the interior of said envelope to help cause the proper orientation of the insert member relative to the envelope window.

2. An envelope system according to claim 1, wherein said top portion includes a truncated corner, for permitting said top portion to be inserted within the interior of said envelope in one orientation only.

3. An envelope system according to claim 2, wherein said top portion further includes information indicia thereon, said information indicia being viewable in the window of said envelope when said top portion is inserted within the interior of said envelope.

4. An envelope system according to claim 1, wherein said securing means is an adhesive.

5. An envelope system according to claim 4, wherein said adhesive is disposed in the interior area of the envelope adjacent its lower left corner.

6. An envelope system according to claim 4 wherein said adhesive is disposed in the interior area of the envelope adjacent its lower right corner.

7. An envelope system according to claim 1, wherein said securing means is a plurality of perforation extending through the surfaces of both the front and back panel of said envelope.

8. An envelope system according to claim 7, wherein said perforations are disposed in the area of the envelope adjacent its bottom right corner.

9. An envelope system according to claim 1, wherein said securing means is a single staple disposed adjacent the left edge of said envelope in spaced apart relation from the top edge of said envelope; said staple being disposed in a downward angular orientation.

10. An envelope system according to claim 1, wherein said securing means is a single staple disposed adjacent the right edge of said envelope in spaced apart relation from the top edge of said envelope; said staple being disposed in a downward angular orientation.

11. An envelope system according to claim 1, wherein said securing means is at least one staple disposed in the bottom left corner of said envelope, said staple being oriented in a spaced apart manner from both the bottom edge and the left edge of said envelope.

12. An envelope system according to claim 1, wherein said insert member includes instruction indicia thereon, said instruction indicia providing directions for separating said top and bottom portions of said insert member along said tear line of perforations.

13. An envelope system according to claim 1, wherein said bottom portion includes a truncated portion along a portion of its bottom edge.

14. An envelope system according to claim 2, wherein said top portion includes a truncated portion along its top edge.

15. An envelope system including an envelope insert member for insertion in an interior pocket of a window envelope having a front and back panel connected in facing relation along their bottom, left and right edges, said front and back panels forming a closable opening to the interior of said envelope;

securing means disposed within the interior of said envelope and extending diagonally between a side edge and the bottom edge thereof for binding together a portion of the interior of said front and back panels of said envelope; and said portion defining a stop within the interior of said envelope and defining an interior envelope insert member receiving space, said space being substantially the same size as said envelope insert member, comprising:

a document having a tear line of perforations extending from its right side edge to its left side edge, said tear line of perforations dividing said document into a top portion and a bottom portion;

at least one of said top and bottom portions having a manually removable portion, said removable portion being defined by a tear line of perforations intersecting at least one edge of said document for enabling a user to form a stop engageable portion of the envelope insert member; and said stop engageable portion being disposed on the envelope insert member in a similar orientation as the position of said stop member to permit said stop engageable portion to be positioned adjacent to said stop when the envelope insert member is disposed within the interior of said envelope to help cause the proper orientation of the insert member relative to the envelope window.

16. An envelope system as defined in claim 15, wherein said top portion includes a truncated corner, for permitting the top portion to be inserted within the interior pocket of the envelope in one orientation only.

17. An envelope system as defined in claim 16, wherein said top portion further includes information indicia thereon, said information indicia being viewable in the window portion of the envelope when said top portion is inserted within the interior of said envelope.

18. An envelope system as defined in claim 15, wherein said insert member includes instruction indicia thereon, said instruction indicia providing directions for separating said top and bottom portions of said insert member along said tear line of perforations.

19. An envelope system as defined in claim 15, wherein said bottom portion includes a truncated portion along a portion of its bottom edge.

20. An envelope system as defined in claim 15, wherein said top portion includes a truncated portion along its top edge.

21. An envelope system comprising: for receiving in one orientation only an invoice member having information indicia thereon, so that the information indicia is viewable through the window of said envelope, said envelope comprising:

a document member having a tear line of perforations extending from its right side edge to its left side edge, said tear line of perforations dividing said document member into a top and bottom portion, wherein at least one of said top and bottom portions is an insert member;

a substantially rectangular envelope having a front and back panel connected in facing relation along their lower, left and right edges; said front and back panels forming a closable opening to the interior of said envelope;

said opening being closable by an integral flap extending from the top edge of the front panel, said flap having sealing means for securing said flap to the exterior surface of said back panel;

said front panel having an opening therein defining a window for permitting at least one surface of said insert member to be viewed when said insert member is disposed within the interior of said envelope;

securing means for binding together a portion of said front and back panels of said envelope, said portion defining a stop within the interior of said envelope;

said document member having a removable portion, said removable portion being defined by a plurality of perforations extending contiguously in a line along at least one edge of said document;

said removable portion having a shape that substantially conforms to the shape of said stop for permitting only that portion of the document member having said removable portion to be received within the interior of said envelope; and said securing means is a crimp disposed along a portion of the bottom edge of said envelope.

* * * * *

UNITED STATES PATENT AND TRADEMARK OFFICE

CERTIFICATE OF CORRECTION

PATENT NO. : 4,919,325

DATED : April 24, 1990

INVENTOR(S) : William P. Culver

It is certified that error appears in the above-identified patent and that said Letters Patent is hereby corrected as shown below:

On the title page:

In the references cited, after 1,601,318, delete "6/1931", and substitute --9/1926--;

In [57] ABSTRACT, before "envelope", delete "invention", and substitute --inventive--.

Column 1, line 44, after "manner", insert --.--.

Column 6, line 28, after "41", delete "20".

Column 7, line 58, after "pre-printed", insert --address indicia 96A--.

Column 10, line 29, after "comprising:", delete "for receiving in one orientation only an invoice member having information indicia thereon, so that the information indicia is viewable through the window of said envelope, said envelope comprising:".

Signed and Sealed this

Twenty-fifth Day of August, 1992

*Attest:*

DOUGLAS B. COMER

*Attesting Officer*

*Acting Commissioner of Patents and Trademarks*